US006134724A

United States Patent [19]

Brown

[11] Patent Number: 6,134,724

[45] Date of Patent: Oct. 24, 2000

[54] EXTENDABLE BED

[76] Inventor: Sue E. Brown, 3122 Mayfair Dr., Carrollton, Tex. 75007

[21] Appl. No.: 09/264,592

[22] Filed: Mar. 8, 1999

[51] Int. Cl.[7] ..... A47C 17/04

[52] U.S. Cl. ..... 5/18.1; 5/118

[58] Field of Search ..... 5/18.1, 17, 118, 5/661

[56] References Cited

U.S. PATENT DOCUMENTS

| | | | |
|---|---|---|---|
| 2,997,724 | 8/1961 | Heumann | 5/18.1 |
| 3,596,981 | 8/1971 | Koziol | 5/37.1 |
| 3,710,403 | 1/1973 | Weidner et al. | 5/18.1 |
| 3,729,753 | 5/1973 | Johnson et al. | 5/2.1 |
| 3,974,529 | 8/1976 | Johnson et al. | 5/18.1 |
| 4,067,073 | 1/1978 | Komarov | 5/18.1 |
| 4,107,797 | 8/1978 | Maxwell, Sr. | 5/118 |
| 4,166,299 | 9/1979 | DuShane et al. | 5/18.1 |
| 4,620,335 | 11/1986 | Dodgen | 5/118 |
| 4,637,081 | 1/1987 | Clark | 5/18.1 |
| 4,669,135 | 6/1987 | Gonzalez | 5/37 R |
| 4,803,742 | 2/1989 | Rasnick et al. | 5/18.1 |
| 4,826,235 | 5/1989 | Zwick | 5/118 |
| 5,197,776 | 3/1993 | Brown | 296/65.1 |
| 5,414,872 | 5/1995 | Kessler et al. | 5/37.1 |

*Primary Examiner*—Alexander Grosz
*Attorney, Agent, or Firm*—Dennis T. Griggs

[57] ABSTRACT

An extendable bed assembly that is movable between a first stowed position and a second sleep position includes a mattress, a base panel for supporting the mattress, a bed platform for slideably supporting the base panel and allowing it to slide between the stowed position and sleep position, and a bolster cushion for filling a gap formed between the mattress and the bed platform when in the sleep position. A locking assembly is associated with the bed platform and base panel for selectively restricting movement between the bed platform and base panel. Bed side panels are attached to the base panel for laterally aligning the mattress on the base panel and for guiding relative movement between the base panel and bed platform.

20 Claims, 3 Drawing Sheets

EXTENDABLE BED

BACKGROUND OF THE INVENTION

This invention relates generally to beds, and more particularly to an extendable bed and method for extending a bed that is particularly well suited for use with recreational vehicles.

Recreational vehicles typically include one or more beds. Because the bed and the space around the bed must be used for various other purposes when not in use for sleeping, the beds are typically either regular or queen-size. Those bed sizes may be convenient during times when not being used for sleeping, but those bed sizes can be uncomfortable particularly for tall or larger people.

Conventional recreational vehicles include regular or queen-size beds that are uncomfortable for tall or larger people, who find it difficult to stretch out and relax. A convenient and effective way of retrofitting these beds is desired.

BRIEF SUMMARY OF THE INVENTION

According to the present invention, an extendable bed and method for extending a bed are provided that address the desire to have a larger bed during sleep times and a smaller bed to provide more useable space during non-sleep times. According to one aspect of the present invention, an extendable bed assembly that moves between a first stowed position and a second sleep position includes a mattress, a base panel for supporting the mattress, a bed platform for slidably supporting the base panel and allowing it to slide between the stowed and sleep position, and a bolster member for filling a gap formed between the mattress and the bed platform when in the sleep position.

According to another aspect of the present invention, the extendable bed system may further include a locking subsystem associated with the bed platform and base panel for selectively restricting movement between the bed platform and base panel. According to another aspect of the present invention, the extendable bed may further include side panels coupled to the base panel for laterally aligning the mattress on the base panel and for guiding relative movement between the base panel and bed platform.

According to another aspect of the present invention, a method for retrofitting a bed to make it selectively extendable between a stowed position and a sleep position includes the steps of providing a mattress; providing a base panel; placing the mattress against the base panel; providing a bed platform and causing the bed platform to support the base panel on the platform with the base panel being slidable between the stowed position and the sleep position; and providing a bolster member for filling a gap formed between the mattress and the bed platform to provide a substantially flush extended sleeping surface.

According to another aspect of the present invention, the method of retrofitting a bed further includes locking the base panel on the bed platform to selectively restrict movement therebetween. According to another aspect of the present invention, the method of retrofitting a bed further includes attaching a side panel to the base panel for laterally aligning the mattress on the base panel and for guiding relative movement between the base panel and bed platform.

BRIEF DESCRIPTION OF THE DRAWING

The accompanying drawing is incorporated into and forms a part of the specification to illustrate the preferred embodiments of the present invention. Various advantages and features of the invention will be understood from the following detailed description taken in connection with the appended claims and with reference to the attached drawing figures in which:

DETAILED DESCRIPTION OF THE INVENTION

Figure 1:
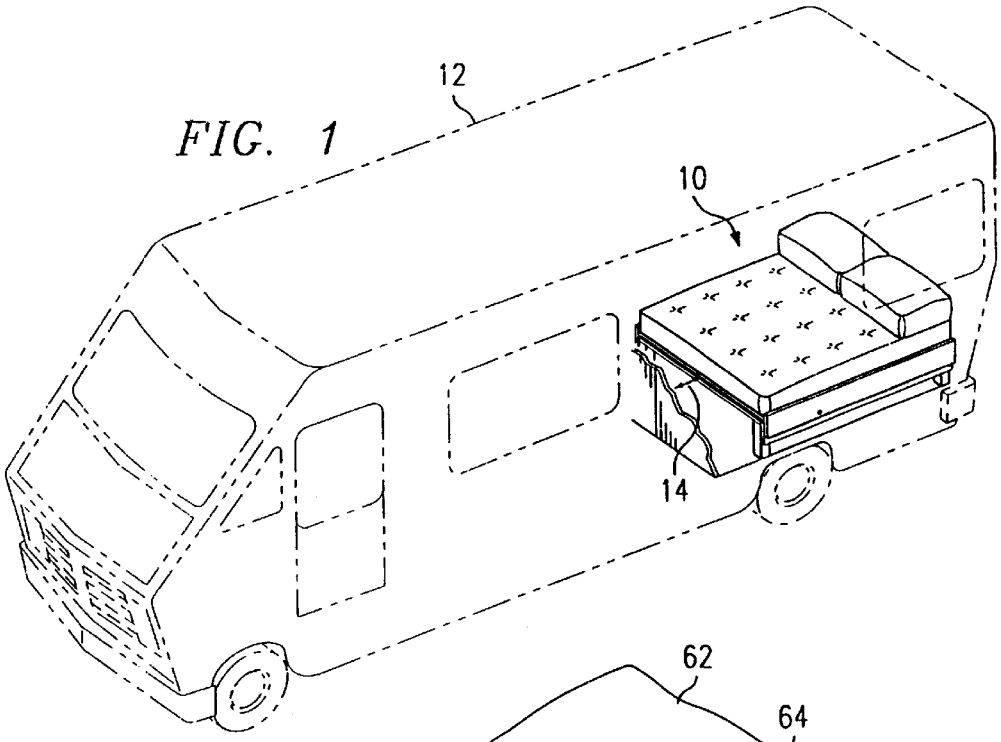
FIG. 1 is a perspective view of one embodiment of the extendable bed of the present invention shown in a stowed position in a recreational vehicle.

The preferred embodiments of the present invention and its advantages are best understood by referring to FIGS. 1–8 of the drawings and the accompanying description. Like reference numerals are used throughout the description and several views of the drawing to indicate like or corresponding parts.

Referring to FIG. 1, an extendable or expandable bed assembly 10 is shown in a bedding area of a recreation vehicle (RV) 12, which is shown in hidden lines. As suggested by the arrow noted by reference numeral 14, the bed assembly is extendable between a first stowed position (shown in FIGS. 1–4) and a second extended or sleep position (shown in FIG. 5). As will be appreciated from the range of movement shown by arrow 14, the stowed position allows the bed assembly 10 to have a small "foot print" and thus allows more useable space to occupants of the recreational vehicle 12. The bed assembly 10 may be installed in a recreational vehicle by an OEM or may be retrofitted into existed vehicles. Furthermore, while presented for illustrative purposes in connection with a recreation vehicle, it is to be understood that it might be applied in other environments as well such as in long-duration aircraft for use by crew members.

Figure 2:
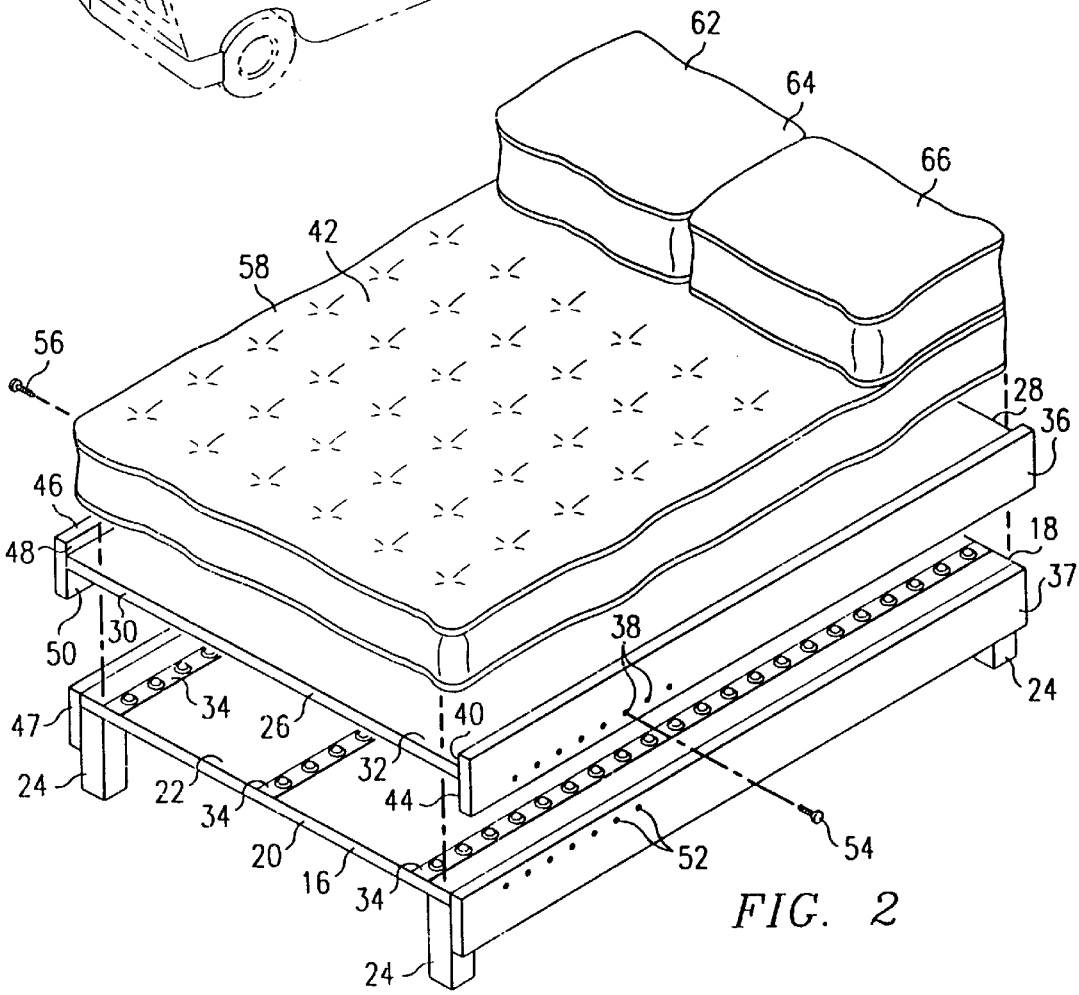
FIG. 2 is a perspective exploded view of the embodiment of the extendable bed show in FIG. 1.
Figure 3:
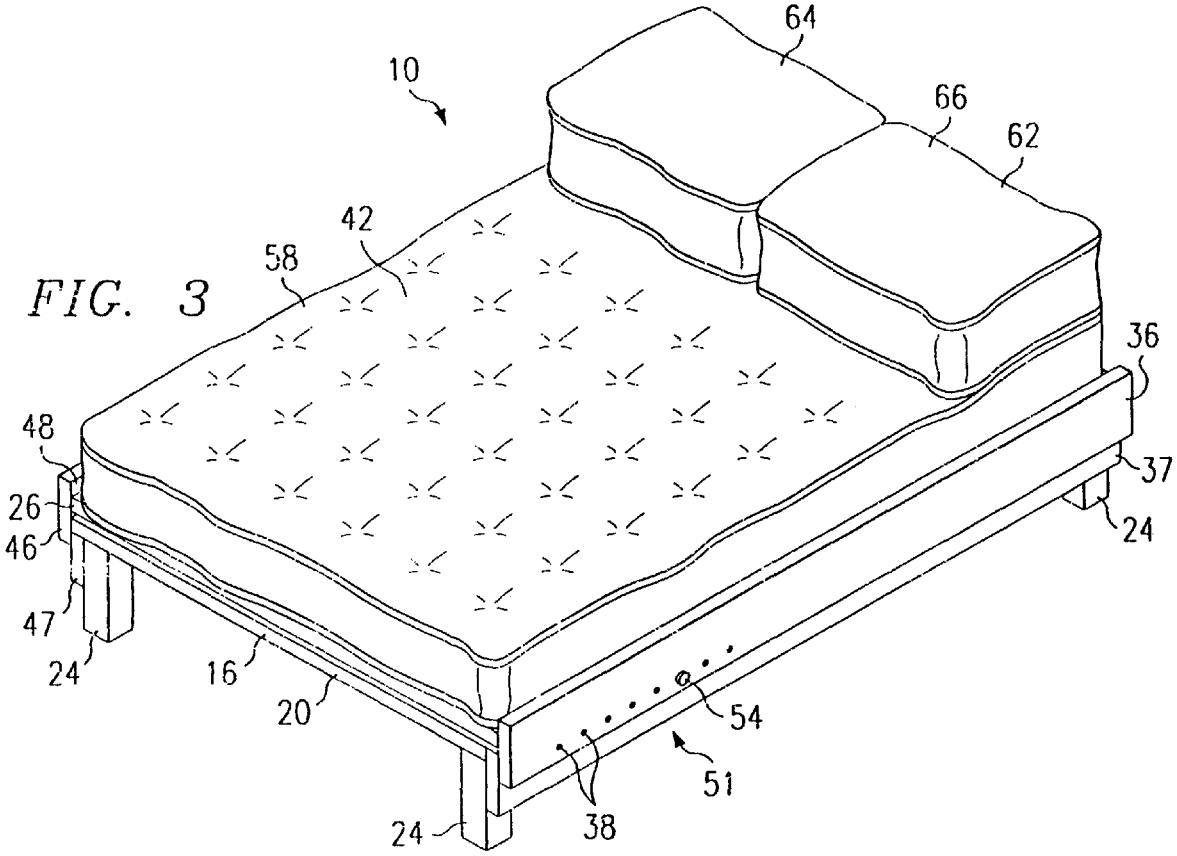
FIG. 3 is a perspective view of the embodiment of the present invention shown in FIGS. 1–2.
Figure 4:
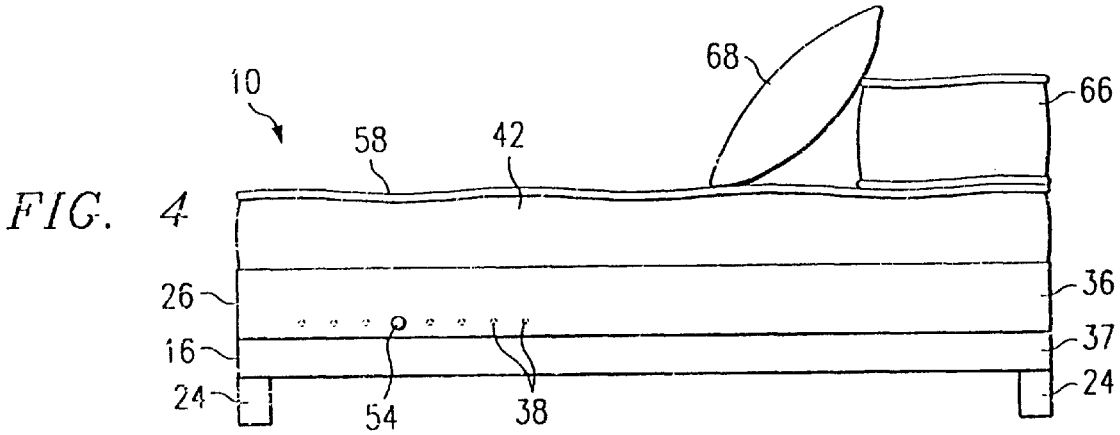
FIG. 4 is a side elevational view of the embodiment of the invention show in FIGS. 1–3 in a stowed position.

Referring now to FIGS. 2–4, the extendable bed assembly 10 includes a bed platform 16 having a first end 18, a second end 20, and a first surface 22. The bed platform is preferably held securely to a portion of the recreational vehicle by a plurality of legs 24. The bed platform supports a base panel 26.

The base panel 26 has a first end 28, second end 30, first surface 32 and a second surface which is underneath the first. The base panel 26 is slidable disposed on and supported by the bed platform 16. The bed platform 16 and base panel 26 are preferably almost the same size with respect to their foot print or surface area for the largest surfaces. This may be accomplished in a simple case by placing the second surface of the base panel 26 against the first surface 22 of the bed platform 16, but more preferably is accomplished by disposing one or more slide devices such as roller bearing tracks 34. Other slide devices for facilitating movement between two platforms include ball bearing strips and plastic roller overlays.

A first side panel 36 is attached to a side portion of base panel 26. The panel 36 is intersected by a plurality of index sockets 38. The panel 36 is preferably attached to base panel 26 in a "T" configuration whereby a first edge portion 40 helps hold a mattress 42 in position on first surface 32 and a second edge portion 44 helps position the base panel 26 with respect to the bed platform 16. Similarly, a second side panel 46 is preferably attached to another side portion of base panel 26 in a "T" configuration with a first edge portion 48 and a second edge portion 50.

A locking subsystem is included as part of the extendable bed assembly 10 to selectively restrict the relative movement between bed platform 16 and base panel 26. The locking subsystem may take numerous forms such as a mechanical latch or a index pin and an array of index sockets as shown in the embodiment of FIGS. 1–5. In this preferred arrangement, a plurality of index sockets 52 are formed in a side panel 37 of bed platform 16. The plurality of sockets 52 in the bed platform and the plurality of sockets in the side panel 36 are arranged so that at least one socket of each aligns with the other in both the stowed and sleep positions and may be held in the desired position by inserting an index pin 54 through the first socket 38 and into the second socket 52. The index pin 54 is preferably spring-loaded with the spring urging the pin into the sockets. Optionally, a second pair of sockets may be formed on the other side panel and other side panel 47 of the bed platform 16 and a second index pin 56 may be used.

The mattress 42 has a first surface 58 and a second surface, which is opposite the first surface 58. The second surface of mattress 42 is supported by the first surface 32 of base panel 26. The mattress 42 is laterally aligned by side panels 36 and 46 and by edge portions 40 and 48 respectively. The mattress 42 is a conventional original equipment (OEM) mattress that typically has a twin, regular or queen-size length in the sleep position, but will have its effective length increased as described below.

A bolster member, either a cushion or pillow 62, is used to fill a gap (FIG. 5) formed between the first end 18 of the bed platform 16 and the first end 28 of the base panel 26 when the bed system 10 is placed in the sleep position. The bolster member 62 may be constructed of a sturdy foam material or a small mattress insert or any other material that provides sufficient support for a sleeper's head resting on it. For aesthetic reasons, the bolster member 62 preferably is two bolster pillows 64 and 66 that may be placed and used as ordinary pillows on top of the mattress 42 when in the stowed position. Traditional pillows 68 may also be used as shown in FIG. 4.

Figure 5:
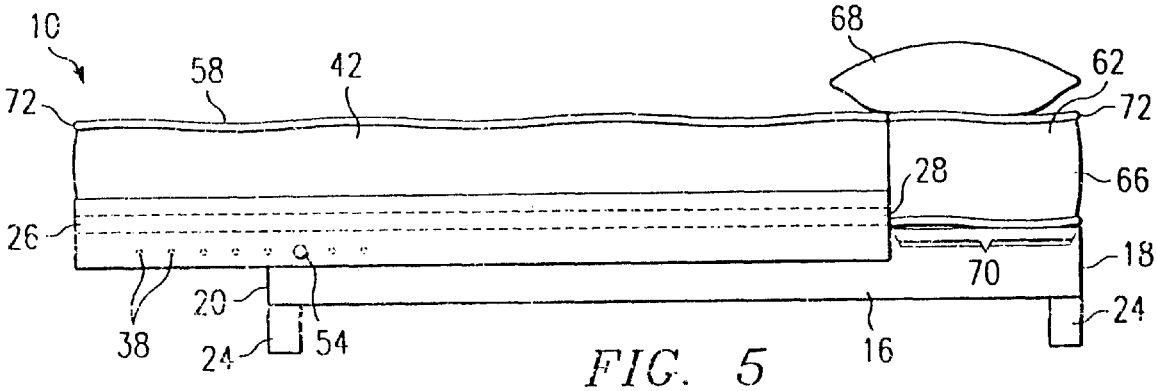
FIG. 5 is a side elevational view of the embodiment of the invention shown in FIGS. 1–4 in a sleep position.

Referring now to FIG. 5, the extendable bed assembly 10 is shown in the second sleep position. As contrasted with FIG. 4, base panel 26 has been extended relative to bed platform 16 so that the second end 30 of base panel 26 extends beyond the second end 20 of bed platform 16. This extension creates a gap 70 formed between first end 28 of the base panel 26 and the first end 18 of the bed platform 16. In order to create a substantially flush extended sleeping surface 72, the bolster member 62 is placed in gap 70. The base panel 26 (with mattress 42 thereon) should not pivot about the second end 20 of bed platform 16 because the center of gravity of the mattress 42 and base panel 26 remains inboard, but in addition, in the preferred embodiment, roller tracks 34 may further prevent any pivoting even if the center of gravity is moved outwardly, for example by a person sitting on the mattress 42 proximate the second end 30 of the base panel 26.

In operation, the user of the bed assembly 10 may move the bed from the stowed position (FIGS. 1–4) to the sleep position (FIG. 5) by releasing the locking assembly, e.g., removing pins 54 and 56, and sliding the base panel 26 relative to the bed platform 16 as suggested by the arrow 14 in FIG. 1. Once the desired length is reached, the locking system may be re-engaged, e.g., sockets 52 and 54 aligned and the pins 54 and 56 put into place. The bolster member 62 may then be placed in the gap 70 to create a larger sleeping area with a substantially flush extended sleep surface 72. The extended sleep surface 72 may then be made-up with form-fitting sheets as a normal bed. In the retracted position of FIG. 4, the mattress 42 and the bolster 62 preferably take on the dimensions of standard twin, regular or queen-size bed when supplied as original equipment by the OEM. In the extended position shown in FIG. 5, the mattress 42 when augmented by the bolster 62 provide an extended bed having dimensions of a larger size, as determined by the length dimension of the bolster 62, thereby extending the effective length of the mattress from the OEM size to the next larger size (e.g. queen-size or king-size length).

Figure 6:
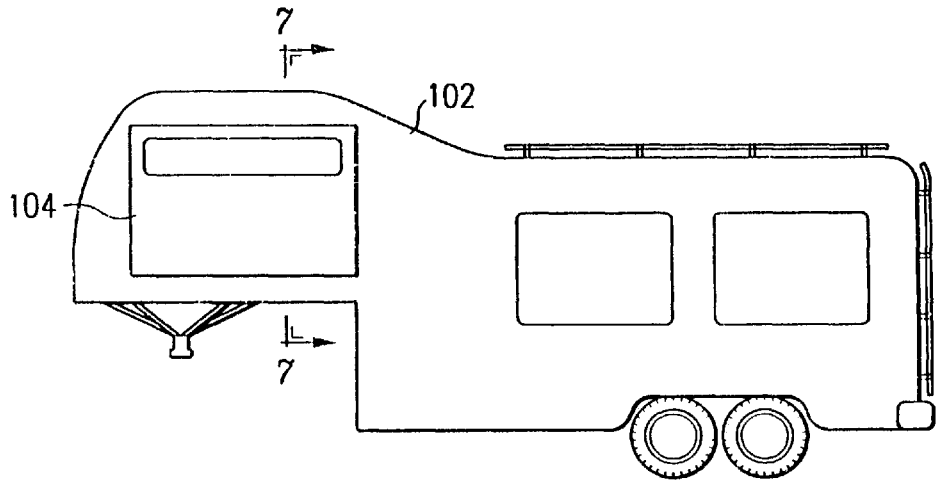
FIG. 6 is an elevational view of a fifth-wheel type recreational vehicle with a slide-out bedroom in which an embodiment of the present invention is well suited.
Figure 7:
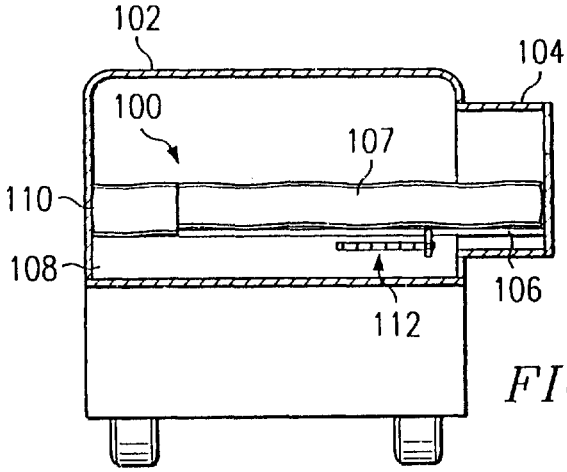
FIG. 7 is a cross-sectional elevational view taken along the line 7—7 of FIG. 6 showing another embodiment of the extendable bed of the present invention in the sleep position.

The present invention may used to provide an extendable bed in various environments including recreational vehicles. Another example of where it might be used in a fifth-wheel type recreation vehicle as shown in FIGS. 6 and 7. Referring now to FIGS. 6–7, an extendable bed assembly 100 is shown in a fifth wheel trailer 102, which designed to be pulled by a truck. The fifth wheel trailer 102 has a slide out sleeper unit 104. Once safely off the highway and in place, the sleeper unit 104 is extended to allow additional room in the vehicle for sleeping (other portions such as a living room can also slide out). Tighter space constraints for this environment lend themselves to a slightly different preferred embodiment from that previously prevented, most notably requiring a different locking subsystem and the absence of side panels.

Referring to FIG. 7, the extendable bed room unit 104 is shown extended and the extendable bed assembly 100 is shown extended in a sleep position. As with the embodiment of FIGS. 1–5, the bed assembly 100 includes a base panel 106 that slides or extends relative to a bed platform 108 to provide additional sleeping area. If desired, a slide roller device (e.g., the roller strip 34 in FIG. 2) may used to make the relative movement between platform 108 and panel 106 easier. The base panel 106 supports a mattress 107. A bolster member 110 fills a gap formed between a first end of the bed platform 108 and a first end of the base panel 106 and thereby forms a substantially flush extended sleep surface. Relative movement between base panel 106 and bed platform 108 may be selectively restricted by a locking assembly 112.

Figure 8:
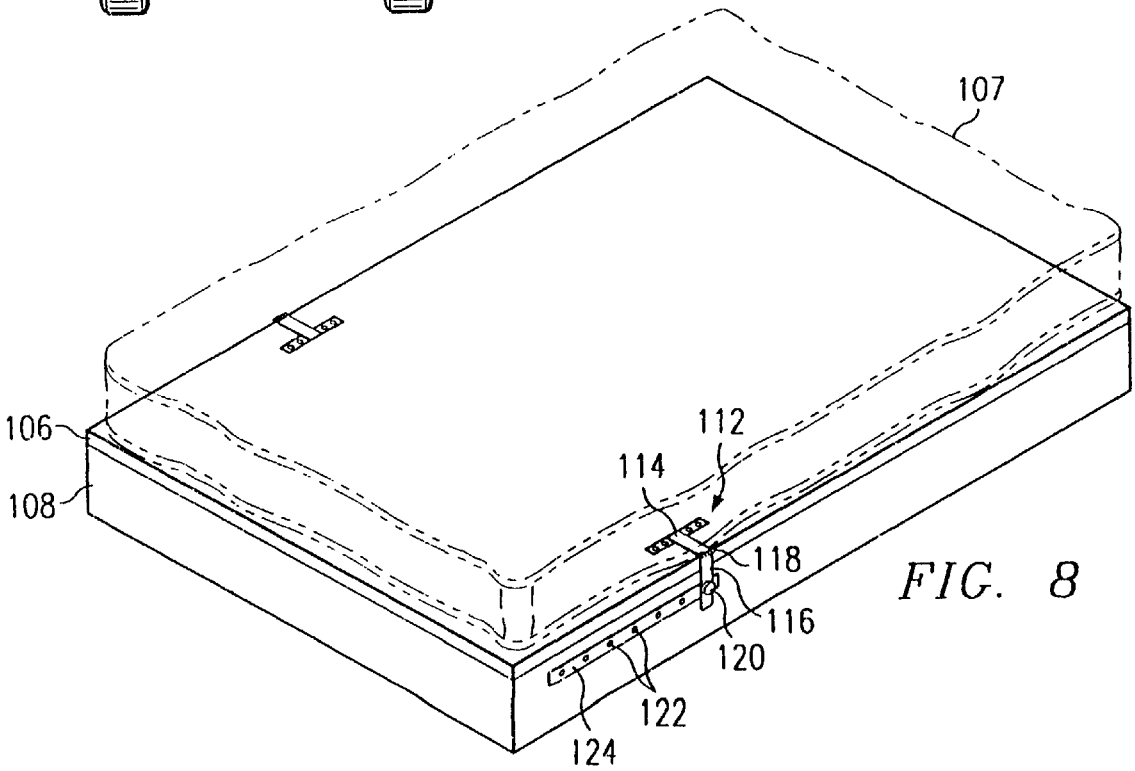
FIG. 8 is a perspective view of a portion of the embodiment of FIG. 7.

Referring now to FIG. 8, the locking assembly 112 is shown in more detail. A first locking arm 114, including a first end and a second end, is coupled to base panel 106. A second locking arm 116 is pivotally coupled by a spring hinge 118 to the second end of first locking arm 114. The second locking arm 116 is formed with an aperature for receiving an index pin 120. When in the stowed or sleep position, the index pin 120 aligns with a selected index socket 122 formed on the bed platform 108. Multiple index sockets 122 may be formed on or further supported by a metal bracket 124 attached to the platform 108.

In operation, the extendable bed assembly 100 is used by sliding the base panel 106 to its extended position relative to the bed platform 108 and using the locking assembly 112 to secure the mattress in a desired extended position. This is accomplished by lining up the index pin 120 with a selected socket 122. A gap between the head end of the bed platform 108 and the head end of the base panel 106 is filled with a bolster 110 to provide a substantially flush extended sleeping surface.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

What is claimed is:

1. An extendable bed assembly comprising:

a bed platform including a first end, a second end, and a top for supporting a base panel;

a base panel including a first end, a second end, a top for supporting a mattress and a bottom for engaging a slide device;

a roller slide device disposed between the bed platform and the base panel, the roller slide device being operable to facilitate extension and retraction movement of the base panel relative to the bed platform between a stowed position and a sleep position; and, a locking assembly releasably interconnecting the bed platform and base panel for selectively restricting movement of the base panel relative to the bed platform.

2. The extendable bed assembly of claim 1, further comprising:

a first side panel coupled to the base panel;

a second side panel coupled to the base panel, the first and second side panels forming laterally spaced sidewalls that limit lateral movement of a mattress supported on the base panel.

3. The extendable bed assembly of claim 2 wherein the first side panel is intersected by a first set of index sockets and wherein the bed platform is intersected by a second set of index sockets with index sockets of the first and second sets lining up at least partially when the base panel is in the stowed position and in the sleeping position, and wherein the locking assembly comprises an index pin for insertion into an aligned pair of the index sockets.

4. The extendable bed assembly of claim 3 wherein the index pin is a spring-loaded index pin.

5. The extendable bed assembly of claim 1 further comprising a mattress having a first end, a first side surface and a second side surface, the second side surface of the mattress being engagable against the top of the base panel, and further comprising a bolster member for filling a gap formed between the first end of the mattress and the first end of the bed platform to provide a substantially flush extended sleeping surface when the base panel is in the sleep position.

6. The extendable bed assembly of claim 1 wherein the roller slide device comprises a plurality of track-mounted rollers.

7. The extendable bed assembly of claim 1 wherein the mattress and bolster in the sleep position have the combined length dimension of a conventional king-size mattress.

8. The extendable bed assembly of claim 1 wherein the mattress and bolster in the sleep position have the combined length dimension of a conventional queen-size mattress.

9. The extendable bed assembly of claim 1 wherein the mattress and bolster in the sleep position have the combined length dimension of a conventional twin-size mattress.

10. The extendable bed assembly of claim 1 wherein the base panel and bed platform are sized and configured to have approximately the same surface area on the second surface of the base panel and the first surface of the bed platform.

11. An extendable bed assembly movable to a first stowed position and to a second sleep position, the bed assembly comprising:

a mattress having a first end, a first surface, and a second surface;

a base panel having a first end, a second end, a first surface and a second surface, the first surface of the base panel being disposed subjacent to the mattress;

a bed platform having a first end, a second end and a top for supporting the base panel and located subjacent to the base panel, the base panel being slidable relative to the bed platform for extension and retraction movement between the first stowed position and the second sleep position;

a bolster member for filling a gap formed between the first end of the mattress and the first end of the bed platform to provide a substantially flush extended sleeping surface when the base panel is in the sleep position;

a locking assembly releasably interconnecting the bed platform and base panel for selectively restricting movement of the base panel relative to the platform, the locking assembly including a plurality of index sockets formed on the bed platform;

a first lock arm attached to the base panel;

a second lock arm including a first end and a second end;

a hinge coupled to the first lock arm and first end of the second lock arm to allow pivotal movement therebetween; and, an index pin disposed on the second end of the second lock arm, the index pin being insertable into at least one of the index sockets thereby opposing relative movement between the bed platform and base panel.

12. The extendable bed assembly of claim 11 further comprising:

a first side panel coupled to the base panel; and a second side panel coupled to the base panel, the first and second side panels forming laterally spaced sidewalls disposed in slidable engagement with the bed platform for guiding extension and retraction movement of the base panel relative to the bed platform.

13. The extendable bed assembly of claim 11, including a bias spring coupled to the index pin for urging the index pin into the aligned pair of sockets.

14. The extendable bed assembly of claim 11, including a roller slide device disposed between the base panel and the bed platform wherein the roller slide device comprises a plurality of track-mounted rollers coupled to the bed platform.

15. The extendable bed assembly of claim 11 wherein the mattress and bolster in the sleep position have the combined dimensions of a king-size mattress.

16. The extendable bed assembly of claim 11 wherein the mattress and bolster in the sleep position have the combined dimensions of a queen-size mattress.

17. The extendable bed assembly of claim 11 wherein the mattress and bolster in the sleep position have the combined dimensions of a twin-size mattress.

18. A method for retrofitting a bed to make it selectively extendable between a stowed position and a sleep position, the method comprising the steps of:

providing a mattress having a first end, a body support side surface, and a base support side surface;

providing a base panel having a first end and a second end and a first side surface and a second side surface;

placing the base support side surface of the mattress against the first side surface of the base panel;

providing a bed platform having a first end, a second end and a first surface;

supporting the base panel on the bed platform with the base panel slideable between the first stowed position and the second sleep position;

placing a bolster member into a gap formed between the first end of the mattress and the first end of the bed platform to provide a substantially flush extended sleeping surface; and, releasably locking the base panel onto the bed platform to selectively fix the base panel in the sleep position and in the stowed position.

19. The method of claim 18 further comprising the steps of:

attaching a first side panel to the base panel; and attaching a second side panel to the base panel; and, guiding the base panel between the first and second side panels during movement between the stowed position and the sleep position.

20. The method of claim 18 further comprising the steps of:

forming the first side panel with a first plurality of index sockets;

forming the bed platform with a second plurality of index sockets with the first and second plurality of index sockets lining up at least partially when in the stowed position and when in the sleeping position; and releasably locking the base panel onto the bed platform by inserting an index pin into one of the first and second plurality of index sockets to selectively restrict relative movement between the bed platform and the base panel.

* * * * *